United States Patent [19]

Anderson et al.

[11] Patent Number: 4,651,653

[45] Date of Patent: Mar. 24, 1987

[54] SORBENT INJECTION SYSTEM

[75] Inventors: David K. Anderson, Longmeadow, Mass.; Martin J. Kozlak, Tariffville, Conn.

[73] Assignee: Combustion Engineering, Inc., Windsor, Colo.

[21] Appl. No.: 882,320

[22] Filed: Jul. 7, 1986

[51] Int. Cl.[4] ..... F23B 7/00; F23J 11/00; F23G 5/00

[52] U.S. Cl. ..... 110/234; 110/345; 110/347; 110/245; 122/4 D

[58] Field of Search ..... 110/260–265, 110/347, 203, 245, 345, 344, 234; 122/4 D

[56] References Cited

U.S. PATENT DOCUMENTS

| | | | |
|---|---|---|---|
| 4,279,205 | 7/1981 | Perkins et al. | 122/4 D |
| 4,355,601 | 10/1982 | Hattiangadi | 122/4 D |
| 4,475,472 | 10/1984 | Adrian et al. | 110/347 |
| 4,499,857 | 2/1985 | Wormser | 122/4 D |
| 4,509,436 | 4/1985 | Schrofelbauen et al. | 110/347 |
| 4,525,142 | 6/1985 | Gleason et al. | 110/345 |
| 4,547,351 | 10/1985 | Im et al. | 110/345 |
| 4,555,996 | 12/1985 | Torbov et al. | 110/345 |
| 4,603,037 | 7/1986 | Yoon | 110/345 |

*Primary Examiner*—Henry C. Yuen
*Attorney, Agent, or Firm*—Arthur E. Fournier, Jr.

[57] ABSTRACT

A furnace (10) having burner means (12) associated with it for burning a sulfur-bearing fuel. Sorbent material, such as limestone, is introduced through nozzles (34) along a pipe (32) extending across the width of the furnace above the nose (31) in the upper portion of the furnace, so that the pipe and the sorbent are protected from heat radiation from the combustion within the furnace.

2 Claims, 2 Drawing Figures

SORBENT INJECTION SYSTEM

BACKGROUND OF THE INVENTION

In recent times, coal has become a viable fuel for generating steam. Some coals include sulfur-containing compounds, which will be released to the atmosphere in the form of hydrogen sulfide or sulfur oxides, unless steps are taken to prevent this release. One means of preventing this $SO_x$ release to the atmosphere which is presently being used is to add a sorbent, such as limestone, to the furnace, so that the sulfur combines with the calcium and magnesium to form solid sulfates. There are problems involved with this solution. The limestone must be added at the proper place in the furnace so that the limestone is not dead-burned. Also, the limestone must be dispersed throughout the combustion gases such that it will come into contact with and react with most of the sulfur compounds, and stay in contact for an extensive period of time, at the proper temperature (2400°-1400° F.), so that much of the sulfur will combine with the calcium and magnesium to form sulfates.

SUMMARY OF THE INVENTION

In accordance with the invention, sorbent, such as limestone, is introduced above the "nose" into the furnace, where a sulfur-bearing fuel is burned. This sorbent is introduced across the entire width of the furnace, so that most of the combustion gases are exposed to the sorbent particles. The absorbing quality of the sorbent is protected from heat radiation from the furnace at this location, minimizing "dead-burning" of the particles. The gas temperature above the furnace nose is approximately 2400° F. which is ideal as far as reaction with the sulfur compounds is concerned.

DESCRIPTION OF THE PREFERRED EMBODIMENT

Figure 1:
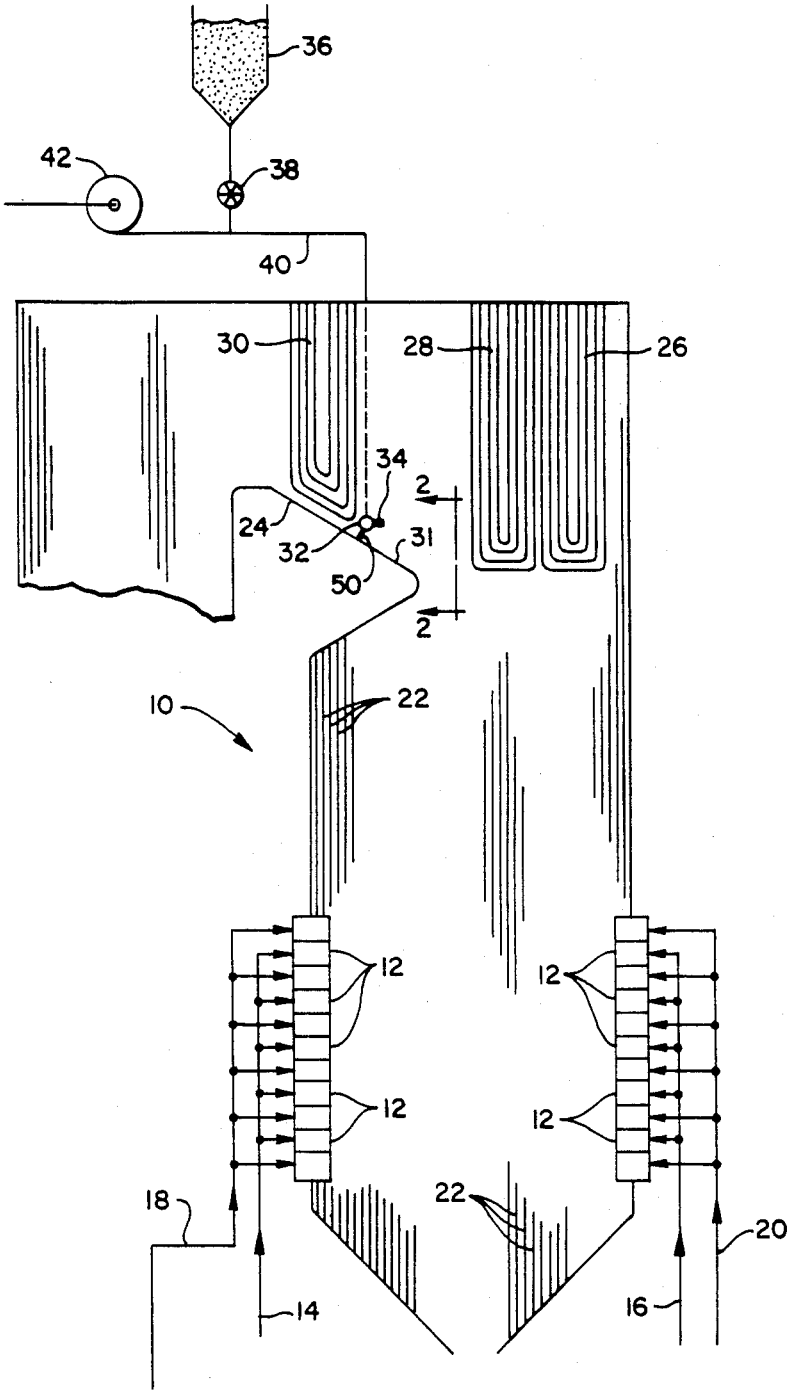
FIG. 1 is a cross-sectional side view of a furnace incorporating the invention.

Looking now to FIG. 1, a fossil fuel fired furnace 10 is shown having a plurality of levels of burners 12 therein with each level having a burner mounted in each of the four corners thereof. Coal or oil-containing sulfur is supplied to the burners through lines 14 and 16, and air to support combustion of the fuel is supplied through lines 18 and 20.

The combustion gases flowing upwardly through the furnace give up heat to the steam generating tubes 22 lining all four walls of the furnace, before exiting the furnace through horizontal paths 24. Contained in the upper portion of the furnace, and the pass 24, are a plurality of superheater or reheater platens 26, 28 and 30.

During combustion, the sulfur in the fuel combines with oxygen to form sulfur oxides, or $SO_x$ which if allowed to escape to the atmosphere can cause "acid rains", and can have other detrimental effects.

Sorbent material, such as limestone, is introduced into the upper portion of the furnace or entrance to the horizontal pass 24 just above the nose 31. The sorbent is carried in an air stream, in dense phase form, to pipe 32, and is discharged through a plurality of nozzles 34.

The nozzles inject the sorbent, of flour-like consistency, into the oncoming combustion gases so that the residence time of the limestone is prolonged in the vicinity of the furnace outlet. The calcium and magnesium in the sorbent react with the sulfur to form sulfates, thus removing the sulfur from the gases exiting to the atmosphere. In order to enhance the reaction, the sorbent particles should be well dispersed throughout the gases, and should remain so for as long a period of time as possible within the temperature range of 2400°-1400° F. The temperature of the combustion gases flowing into the bottom portion of the superheater platens 26, 28 and 30 is generally in the range of 2400° F.

The sorbent is fed from a hopper 36 through a rotary air lock 38, to line 40. A fan 42 pressurizes the line 40, conveying the sorbent to the pipe 32 and the nozzles 34. The sorbent should be introduced into the furnace from nozzles 34 with sufficient velocity (40–50 fps) so that it is dispersed throughout a substantial portion of the gas stream.

Figure 2:
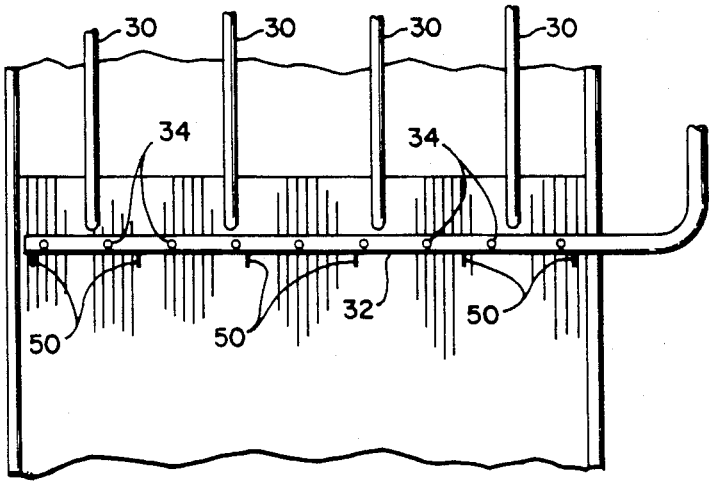
FIG. 2 is a view taken on lines 2—2 of FIG. 1.

Depending on the distance between the superheater panels 30 to nozzles 34 can be located between each panel (FIG. 2). There should be a sufficient number of nozzles so that the plume of sorbent issuing therefrom adequately covers the entire cross-section of the furnace outlet.

As seen in FIG. 2, the pipe 32 is supported by a plurality of bars 50, which are welded to the tubes beneath them, and to the pipe 32 thereabove. Since pipe 32 is air cooled, and the tubes on the floor of the nose or arch 31 are fluid-cooled, the short lengths of the bars 50 are adequately cooled to prevent heat damage. This is especially so since they are protected from heat radiation from the furnace by the nose 31.

What is claimed is:

1. In combination, a furnace, burner means associated with the furnace, means for supplying a sulfur-bearing fuel and air to the burner means, the furnace having four side walls and a roof, a horizontal passageway extending from the upper portion of the furnace, the upper portion of one of the side walls being bent inwardly and upwardly, to form an arch in the upper portion of the furnace, above which the horizontal passageway extends, said one of the side walls forming the floor of the passageway, pipe means located above the arch, a plurality of short bars welded to the floor of the passageway, said bars being attached to and supporting the pipe means, means for introducing a sorbent, such as limestone, to the furnace through the pipe means, the pipe means having a plurality of nozzles, which discharge the sorben in a direction opposite to the gas flow through the horizontal passageway, thus maximizing the residence time of the sorbent in the horizontal passageway, so that some of the sulfur reacts with the sorbent, thus being removed from the gases leaving the furnace.

2. The combination set forth in claim 1, wherein all four walls of the furnace are lined with fluid-cooled tubes and gases above the arch are at approximately 2400° F.

* * * * *